US011265987B1

(12) United States Patent
Lu et al.

(10) Patent No.: US 11,265,987 B1
(45) Date of Patent: Mar. 1, 2022

(54) LAMP WITH ANTI-SHOCK PROTECTION AND COMPATIBLE WITH MULTIPLE POWER SUPPLY MODES

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/341,409

(22) Filed: Jun. 8, 2021

(30) Foreign Application Priority Data

Feb. 21, 2021 (CN) ..... 202110194636.4

(51) Int. Cl.
*H05B 45/3575* (2020.01)
*F21V 23/02* (2006.01)
*H05B 45/345* (2020.01)

(52) U.S. Cl.
CPC ..... *H05B 45/3575* (2020.01); *F21V 23/02* (2013.01); *H05B 45/345* (2020.01)

(58) Field of Classification Search
None
See application file for complete search history.

(56) References Cited

U.S. PATENT DOCUMENTS

2014/0265900 A1* 9/2014 Sadwick ..... H05B 45/395 315/200 R
2019/0032864 A1* 1/2019 Xiong ..... F21K 9/272
2020/0256521 A1* 8/2020 Xiong ..... F21V 23/023

* cited by examiner

*Primary Examiner* — Alan B Cariaso
(74) *Attorney, Agent, or Firm* — Winston Hsu

(57) ABSTRACT

A lamp with anti-shock protection and compatible with a plurality of power supply modes is provided. The lamp includes a plurality of lighting elements and a control circuit. The control circuit includes an electric shock protection circuit, a filtering and constant current driving circuit, a type A electronic rectifier circuit and a fast-start inductive rectifier detection and driving circuit. The fast-start inductive rectifier detection and driving circuit includes a first resistor R11, a TVS1 and a PTC resistor. The PTC resistor is electrically connected in series with the TVS1. The first resistor R11 is connected in parallel to both ends of the TVS1 as a dummy load. The input voltage rectification and voltage clamping module rectifies the input AC voltage to convert it to pulsating DC voltage and then clamps the rectified pulsating DC voltage as the power supply for the signal transmission component U1.

11 Claims, 2 Drawing Sheets

LAMP WITH ANTI-SHOCK PROTECTION AND COMPATIBLE WITH MULTIPLE POWER SUPPLY MODES

CROSS REFERENCE TO RELATED APPLICATION

This application claims priority to China Patent Application No. 202110194636.4, filed 2021 Feb. 21, and included herein by reference in its entirety.

BACKGROUND OF THE INVENTION

1. Field of the Invention

The invention relates to a lamp and, more particularly, to a lamp with anti-shock protection and compatible with a plurality of power supply modes (such as electronic rectifiers, fast inductive rectifiers and mains power supplies).

2. Description of the Prior Art

In recent years, with the trend of energy saving and emission reduction, LED (light-emitting diode) light sources are wildly used in different markets. LED lighting sources provide an innovative lighting device and reduces energy consumption effectively. They will be widely used in power-deficient areas and global market in future.

Conventional fluorescent lighting devices on the market mainly include lamp holders, fluorescent tubes and electronic ballasts. To replace the fluorescent tubes with LED tubes to save power, electronic ballast LED tubes with same specifications are needed, and the whole lamp holder also needs to be replaced. However, it is time-consuming and costly.

SUMMARY OF THE INVENTION

A lamp with anti-shock protection and compatible with a plurality of power supply modes is provided. Two conductive pin sets are configured at two end of the lamp to be electrically connected to a power supply, respectively, the conductive pin set includes two pins, the lamp includes a plurality of lighting elements and a control circuit, the control circuit is electrically connected to the lighting elements and the two conductive pin sets respectively, the control circuit includes an electric shock protection circuit, a filtering and constant current driving circuit, an electronic rectifier circuit and a fast-start inductive rectifier detection and driving circuit, the electric shock protection circuit is connected to the filtering and constant current driving circuit, the electronic rectifier circuit is connected to the electric shock protection circuit and the fast-start inductive rectifier detection and driving circuit, the fast-start inductive rectifier detection and driving circuit further includes an input voltage rectification and voltage clamp module, a fast-start inductive rectifier pre-driver module, a fast-start inductive rectifier identification module, a fast-start inductive rectifier identification module electrically connected to each other, the input voltage rectifier and voltage clamp module includes a first resistor, a transient voltage suppressor diode, and a positive temperature coefficient thermistor, the positive temperature coefficient thermistor is electrically connected in series with the transient voltage suppressor diode, the first resistor is connected in parallel with the transient voltage suppressor diode at two ends of the transient voltage suppressor diode as a dummy load, the input voltage rectification and voltage clamp module rectifies an input AC voltage to convert the AC voltage to a pulsating DC voltage and clamps the rectified pulsating DC voltage through the first resistor, the transient voltage suppression diode, and the positive temperature coefficient thermistor as a power supply for a signal transfer assembly.

In summary, according to embodiments, besides the electric shock protection circuit, the filtering and constant current drive circuit and the type A electronic rectifier circuit, the control circuit further includes the fast-start inductive rectifier detection and drive circuit. Then, the electronic rectifier is compatible with fast-start inductive rectifier and mains-powered lamps while the leakage protection is reliable. Additionally, the input to the lamp can be from either end of the lamp, and the light adjusting requirement in the rectifier mode can be meet.

These and other objectives of the present invention will no doubt become obvious to those of ordinary skill in the art after reading the following detailed description of the preferred embodiment that is illustrated in the various figures and drawings.

DETAILED DESCRIPTION

These and other features, aspects and advantages of the present invention will become better understood with regard to the following description, appended claims, and accompanying drawings.

Via a type A electronic rectifier circuit and a fast-start inductive rectifier detection and drive circuit in an internal control circuit of the lamp, the voltage of the power supply input, the voltage of the electronic rectifier circuit input or the voltage of the fast-start inductive rectifier detection and drive circuit input can be identified. The control circuit includes an electric shock protection circuit. The leakage protection is more reliable. The electronic rectifier is compatible with the fast-start inductive rectifier and the power supply power supply. Additionally, the input to the lamp can be from either end of the lamp, and the light adjusting requirement in the rectifier mode can be meet.

Figure 1:
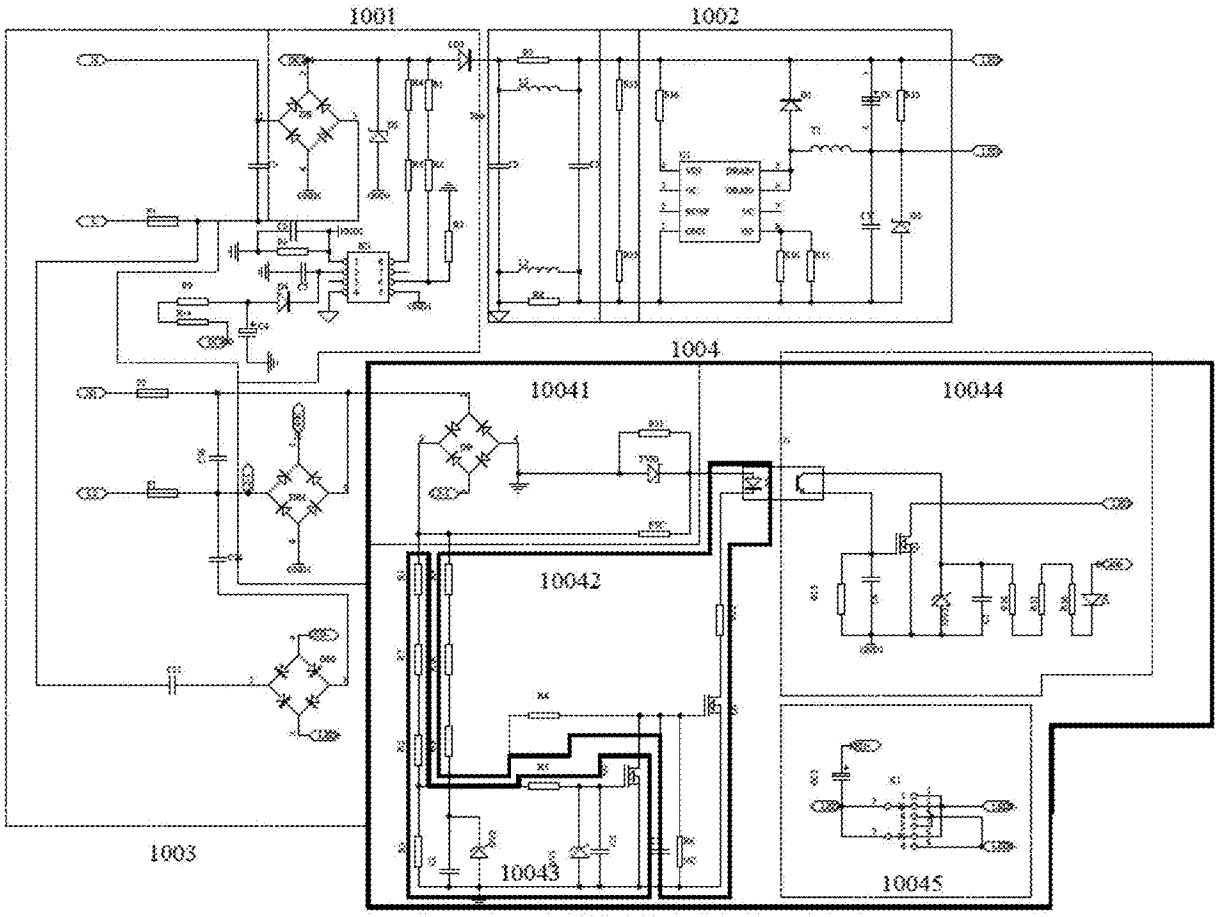
FIG. 1 is a schematic diagram of a control circuit of the lamp according to an embodiment of the present invention.
Figure 2:
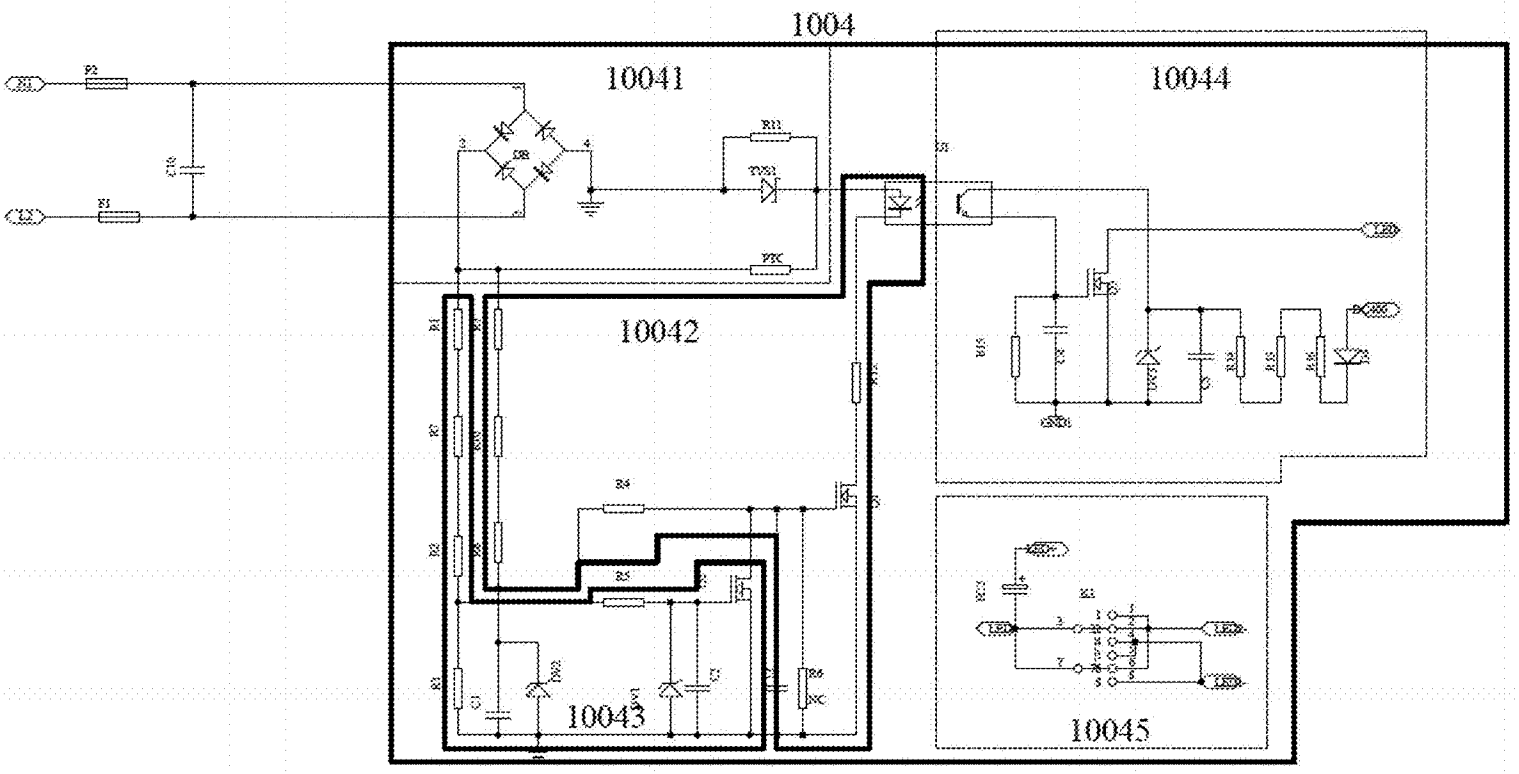
FIG. 2 is a schematic diagram of a fast-start type inductive rectifier detection and driving circuit of a lamp according to an embodiment of the present invention.

Please refer to FIG. 1 and FIG. 2. FIG. 1 is a schematic diagram of a control circuit of the lamp according to an embodiment of the present invention. FIG. 2 is a schematic diagram of a fast-start type inductive rectifier detection and driving circuit of a lamp according to an embodiment of the present invention.

A lamp with electric shock protection and compatible with a variety of power supply modes is provided. Two conductive pin sets are configured at two ends of the lamp to be electrically connected to the power supply. In an embodiment, each conductive pin set includes two pins (such as pins N, L and pins N1, L2). The lamp includes a plurality of lighting elements (such as LED light-emitting components or other light-emitting components) and a control circuit 100. The control circuit 100 are electrically connected to a plurality of lighting elements and two conductive pin sets, respectively.

The control circuit 100 includes an electric shock protection circuit 1001, a filtering and constant current drive circuit 1002, a type A electronic rectifier circuit 1003, and a fast start inductive rectifier detection and drive circuit 1004 which are electrically connected to each other directly or indirectly. In the embodiment, the electric shock protection circuit 1001 is connected to the filtering and constant current drive circuit 1002. The type A electronic rectifier circuit 1003 is connected to the electric shock protection circuit 1001 and the fast start inductive rectifier detection and drive circuit 1004. The electric shock protection circuit 1001 are connected to the two pins at ends of the lamp via rectifier bridges DB and DB1 to avoid the risk of electric shock when the lamp is installed. The filtering and constant current driving circuit 1002 is configured for filtering the DC starting voltage output from the type A electronic rectifier circuit 1003 and adjusting the current output to the light element via the constant current. The fast-start inductive rectifier detecting and driving circuit 1004 includes an input voltage rectification and voltage clamp module 10041, a fast-start inductive rectifier pre-driver module 10042, a fast-start inductive rectifier identification module 10043, a fast-start inductive rectifier output driver module 10044, and an output load selection module 10045 connected to each other. The input voltage rectification and voltage clamp module 10041 is connected to the type A electronic rectifier circuit 1003. The input voltage rectification and voltage clamp module 10041 is connected to the fast-start inductive rectifier pre-driver module 10042 and the fast-start inductive rectifier identification module 10043. The fast-start inductive rectifier pre-driver module 10042 is connected to the fast-start inductive rectifier identification module 10043. The fast-start inductive rectifier output driver module 10044 is connected to the fast-start inductive rectifier pre-driver module 10042. The output load selection module 10045 is connected to the fast-start inductive rectifier output driver module 10044.

In an embodiment, the input voltage rectifier and voltage clamp module 10041 includes a first resistor R11, a transient voltage suppressor diode TVS1 and a positive temperature coefficient thermistor (PTC) resistor. The PTC resistor is electrically connected in series with the transient voltage suppressor diode TVS1. A first resistor R11 (if a resistance value of the resistor ranges from 100 to 100 KΩ) is connected in parallel with two ends of the transient voltage suppressor diode TVS1 as a dummy load. Then, the input voltage rectifier and voltage clamp module 10041 rectifies the input AC voltage to a pulsating DC voltage, and clamps the rectified pulsating DC voltage via the first resistor R11, transient voltage suppressor diode TVS1, and the PTC resistor as the power supply for a signal transmission component U1 (such as a photoelectric coupler, a transformer, a solid state relay, or other isolated coupling devices).

The fast-start inductive rectifier pre-driver module 10042 includes a second resistor R4, a third resistor R6, a fourth resistor R8, a fifth resistor R9, a sixth resistor R10, a seventh resistor R12, a third capacitor C3 and a first MOS tube Q1. The voltage of the first capacitor C1 and the voltage regulator tube DV2 is divided via the fourth resistor R8, the fifth resistor R9, and the sixth resistor R10. The first capacitor C1 has the filtering, the voltage regulator tube DV2 has the voltage clamping, and the second resistor R4 limits the current. Then, the third capacitor C3 is charged. At the time, the voltage across the ends of the third capacitor C3 is higher than the gate turn-on voltage of the first MOS tube Q1. The pulsating DC voltage signal after the rectification of the first MOS tube Q1 is clamped by the first resistor R11, the transient voltage suppression diode TVS1, and the positive temperature coefficient thermistor PTC, and passes through the positive and negative poles of the input terminal of the signal transmission component U1. After the current limit via the seventh resistor R12, the signal passes through the D pole and S pole of the first MOS tube Q1, and then the signal is transmitted to the ground. The signal path is as follows: the pulsating DC voltage signal after the rectification of the first MOS tube Q1 is clamped via the first resistor R11, the transient voltage suppressor diode TVS1, and the positive temperature coefficient thermistor PTC, and then passes through the positive pole of the input terminal of the signal transmission component U1 (such as a photo coupler)→the negative terminal of the signaling component U1, the current limiting of the seventh resistor R12→the D pole of the first MOS tube Q1→the S pole of the first MOS tube Q1→ground. The signal (such as the pulsating DC voltage after rectification) is coupled to the output of the photocoupler while the signal passes through the signal transfer assembly U1 (such as a photocoupler).

The fast-start inductive rectifier identification module 10043 includes an eighth resistor R1, a ninth resistor R2, a tenth resistor R3, an eleventh resistor R5, a twelfth resistor R7, a first capacitor C1, a second capacitor C2, signal clamp regulators DV1, DV2 and a second MOS tube Q2. A voltage divider circuit includes the eighth resistor R1, the ninth resistor R2, the tenth resistor R3, and the twelfth resistor R7. ARC filter circuit includes the eleventh resistor R5 and the second capacitor C2. The maximum voltage across two ends of the filament winding is set according to different fast-start inductive rectifier sets. In an embodiment, when the actual voltage exceeds the preset voltage, a non-fast-start inductive rectifier work mode is a default work mode. For example, the work process: when the voltage of the voltage divider circuit is higher than that of the normal fast-start inductance rectifier operating mode, the voltage across the tenth resistor R3 becomes higher. Then, the voltage signal is current limited by the eleventh resistor R5, and the second capacitor C2 is charged. When the voltage of the second capacitor C2 is higher than the gate conduction voltage of the second MOS tube Q2, the second MOS tube Q2 is conducted. The signal path is as follows: when the voltage across the tenth resistor R3 becomes high→the current limiting of the voltage signal via the eleventh resistor R5→the second capacitor C2 is charged→when the second capacitor C2 voltage is higher than the gate conduction voltage of the second MOS tube Q2→the second MOS tube Q2 is conducted. When the second MOS tube Q2 is conducted, the voltage signal through the first MOS tube Q1 is pulled down, and then the signal transfer assembly U1 (such as a photocoupler) does not output. The fast-start inductive rectifier pre-driver module 10042 is slower than the fast-start inductive rectifier identification module 10043 at least 1 ms at each power-up time.

The fast start type inductive rectifier output driving module 10044 includes a thirteenth resistor R13, a fourteenth resistor R14, a fifteenth resistor R15, the sixteenth resistor R16, a diode D4, a fourth capacitor C4, a fifth capacitor C5, a signal clamp regulator DV3 and a third MOS tube Q3. A drive signal source clamping circuit includes the sixteenth resistor R16, the thirteenth resistance R13, the fourteenth resistance R14, the diode D4, the fifth capacitor C5, and the signal clamp regulator DV3. The drive actuator circuit includes the output terminal of the signal transfer assembly U1 (such as a photocoupler), the third MOS tube Q3, the fifteenth resistor R15 and the fourth capacitor C4. The drive actuator circuit is used to filter and smooth the signal of the output end of the signal transfer assembly U1 to drive the third MOS tube Q3. The signal of the output end of the signal transfer assembly U1 is the signal of the fast start-type inductor rectifier front stage drive module 10042 coupled to the output end through the signal transfer assembly U1 via the signal transfer assembly U1 (such as a photocoupler). In the embodiment, the fast-start inductive rectifier output drive module 10044 is an electronic switch (the third MOS tube Q3), which is not limited herein. In other embodiments, the fast-start inductive rectifier output drive module 10044 is driven and controlled via a mechanical relay or a solid-state relay, and the number the number of switches is not limited herein.

The output load selection module 10045 includes a toggle switch K1 and a filter capacitor EC2. The toggle switch K1 is used to select the output load to change the color temperature or the output power function.

In the embodiment, the rectifier bridge DB directly rectifies the AC signal from the fast-start inductive rectifier identification module 10043 under while the fast-start inductive rectifier identification module 10043 is compatible.

In the embodiment, after the fuse is connected to the pins at two ends of the lamp, the first capacitor C1 and the sixth capacitor C10 with capacitance of 1.0 nF-100 nF are connected in front of the rectifier bridge DB and DB1, respectively.

In this embodiment, the lamp further includes a toggle switch K1 to select the output load, and then the color temperature or the output power function is changed.

To make the lamp compatible with a fast-start inductive rectifier, besides the electric shock protection circuit 1001, the filtering and constant current drive circuit 1002 and the type A electronic rectifier circuit 1003, the control circuit 100 further includes the fast-start inductive rectifier detection and drive circuit 1004. Then, the electronic rectifier is compatible with fast-start inductive rectifier and mains-powered lamps while the leakage protection is reliable. Additionally, the input to the lamp can be from either end of the lamp, and the light adjusting requirement in the rectifier mode can be meet.

Although the present invention has been described in considerable detail with reference to certain preferred embodiments thereof, the disclosure is not for limiting the scope of the invention. Persons having ordinary skill in the art may make various modifications and changes without departing from the scope. Therefore, the scope of the appended claims should not be limited to the description of the preferred embodiments described above.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lamp with anti-shock protection and compatible with a plurality of power supply modes, comprising:

two conductive pin sets are configured at two end of the lamp to be electrically connected to a power supply, respectively, the conductive pin set includes two pins, the lamp includes a plurality of lighting elements and a control circuit, the control circuit is electrically connected to the lighting elements and the two conductive pin sets respectively, the control circuit includes an electric shock protection circuit, a filtering and constant current driving circuit, an electronic rectifier circuit and a fast-start inductive rectifier detection and driving circuit, the electric shock protection circuit is connected to the filtering and constant current driving circuit, the electronic rectifier circuit is connected to the electric shock protection circuit and the fast-start inductive rectifier detection and driving circuit, the fast-start inductive rectifier detection and driving circuit further includes an input voltage rectification and voltage clamp module, a fast-start inductive rectifier pre-driver module, a fast-start inductive rectifier identification module, a fast-start inductive rectifier identification module electrically connected to each other, the input voltage rectifier and voltage clamp module includes a first resistor, a transient voltage suppressor diode, and a positive temperature coefficient thermistor, the positive temperature coefficient thermistor is electrically connected in series with the transient voltage suppressor diode, the first resistor is connected in parallel with the transient voltage suppressor diode at two ends of the transient voltage suppressor diode as a dummy load, the input voltage rectification and voltage clamp module rectifies an input AC voltage to convert the AC voltage to a pulsating DC voltage and clamps the rectified pulsating DC voltage through the first resistor, the transient voltage suppression diode, and the positive temperature coefficient thermistor as a power supply for a signal transfer assembly.

2. The lamp with anti-shock protection and compatible with a plurality of power supply modes according to claim 1, wherein the signal transfer assembly is a photoelectric coupler, a transformer or a solid state relay.

3. The lamp with anti-shock protection and compatible with a plurality of power supply modes according to claim 1, wherein a resistance value of the first resistor ranges from 100 to 100 KΩ.

4. The lamp with anti-shock protection and compatible with a plurality of power supply modes according to claim 1, wherein the fast-start inductive rectifier pre-stage drive module includes a second resistor, a third resistor, a fourth resistor, a fifth resistor, a sixth resistor, a seventh resistor, a third capacitor and a first MOS tube, a voltage is divided via the fourth resistor, the fifth resistor, and the sixth resistor, and the third capacitor is charged when the voltage is clamped after the second resistor has current limit, when the voltage across the ends of the third capacitor is higher than a gate turn-on voltage of the first MOS tube, a pulsating DC voltage signal after the first MOS tube rectification is clamped via the first resistor, the transient voltage suppressor diode, and the positive temperature coefficient thermistor, and then transmitted to positive and negative inputs of the signal transfer assembly, with current limiting of the seventh resistor, the signal passes through a D pole and a S pole of the first MOS tube, and then transmitted to the ground, and when the signal passes through the signal transmission component, the signal is coupled to an input end of a photocoupler.

5. The lamp with anti-shock protection and compatible with a plurality of power supply modes according to claim 1, wherein the fast-start inductive rectifier identification module includes an eighth resistor, a ninth resistor, a tenth resistor, an eleventh resistor, a twelfth resistor, a first capacitor, a second capacitor, two signal clamp regulators and a second MOS tube, a voltage divider circuit includes the eighth resistor, the ninth resistor, the tenth resistor, the twelfth resistor, a RC filter circuit includes the eleventh resistor and the second capacitor, a maximum voltage across two ends of the filament winding is set according to different fast-start inductive rectifier sets, when an actual voltage exceeds a preset voltage, a non-fast-start inductive rectifier work mode is a default work mode, when the voltage of the voltage divider circuit is higher than the voltage of the normal fast-start inductance rectifier operating mode, the voltage across the tenth resistor becomes high, the voltage signal has the current limiting via the eleventh resistor, the second capacitor C2 is charged, when the second capacitor voltage is higher than the gate conduction voltage of the second MOS tube, the second MOS tube is conducted, the voltage signal through the first MOS tube is pulled down to make the signal transfer assembly not output.

6. The lamp with anti-shock protection and compatible with a plurality of power supply modes according to claim 5, wherein the fast-start inductive rectifier pre-stage drive module is at least 1 ms slower than the fast-start inductive rectifier identification module at each power-on time.

7. The lamp with anti-shock protection and compatible with a plurality of power supply modes according to claim 1, wherein the fast-start inductive rectifier output drive module includes a thirteenth resistor, a fourteenth resistor, a fifteenth resistor, a sixteenth resistor, a diode, a fourth capacitor, a fifth capacitor, a signal clamp regulator and a third MOS tube, a drive signal source clamping circuit includes the sixteenth resistor, the thirteenth resistance, the fourteenth resistance, the diode, the fifth capacitor, and the signal clamp regulator, the drive actuator circuit includes an output terminal of the signal transfer assembly, the third MOS tube, the fifteenth resistor and the fourth capacitor, the drive actuator circuit is used to filter and smooth a signal of an output end of the signal transfer assembly to drive the third MOS tube Q3, the signal of the output end of the signal transfer assembly is the signal of the fast start-type inductor rectifier front stage drive module coupled to the output end through the signal transfer assembly via the signal transfer assembly.

8. The lamp with anti-shock protection and compatible with a plurality of power supply modes according to claim 7, wherein the third MOS tube is replaced by a mechanical relay or a solid state relay.

9. The lamp with anti-shock protection and compatible with a plurality of power supply modes according to claim 1, wherein the output load selection module includes a toggle switch and a filter capacitor.

10. The lamp with anti-shock protection and compatible with a plurality of power supply modes according to claim 1, wherein the fast-start inductive rectifier pre-stage drive module is at least 1 ms slower than the fast-start inductive rectifier identification module at each power-on time.

11. The lamp with anti-shock protection and compatible with a plurality of power supply modes according to claim 1, wherein the anti-touch protection circuit is connected to the two pins at two ends of the lamp via two rectifier bridges, after the fuse is connected to the pins at two ends of the lamp, the first capacitor and the sixth capacitor with capacitance of 1.0 nF-100 nF are connected in front of the rectifier bridges, respectively.

* * * * *